US005559533A

United States Patent [19]

Hicok et al.

[11] Patent Number: 5,559,533

[45] Date of Patent: Sep. 24, 1996

[54] VIRTUAL MEMORY HARDWARE CUSOR AND METHOD

[75] Inventors: Gary D. Hicok; Dale C. Penner, both of Mesa; Mike Nakahara, Phoenix, all of Ariz.

[73] Assignee: VLSI Technology, Inc., San Jose, Calif.

[21] Appl. No.: 316,063

[22] Filed: Sep. 30, 1994

Related U.S. Application Data

[63] Continuation of Ser. No. 42,331, Apr. 2, 1994, abandoned.

[51] Int. Cl.[6] ..... G09G 5/08

[52] U.S. Cl. ..... 345/162; 345/145; 345/197

[58] Field of Search ..... 345/145, 156, 345/157, 162, 150, 197, 185

[56] References Cited

U.S. PATENT DOCUMENTS

| | | | |
|---|---|---|---|
| 4,668,947 | 5/1987 | Clarke, Jr. et al. | 345/162 |
| 4,835,526 | 5/1989 | Ishii et al. | 345/150 |
| 4,987,551 | 1/1991 | Garrett | 345/162 |
| 5,146,211 | 9/1992 | Adams et al. | 345/203 |
| 5,196,837 | 3/1993 | Shoji et al. | 345/145 |
| 5,345,252 | 9/1994 | Harrah | 345/162 |

FOREIGN PATENT DOCUMENTS

| | | | |
|---|---|---|---|
| 0418859 | 3/1991 | European Pat. Off. | 345/162 |
| 2125290 | 5/1990 | Japan | 345/162 |
| 2188787 | 7/1990 | Japan | 345/157 |
| 2235355 | 2/1991 | United Kingdom | 345/162 |

OTHER PUBLICATIONS

"High Performance VGA Controller Chip for PC/XT/AT and PS/Z Systems" by Western Digital in 1990.

"BT 485 Data Sheet" by Brooktree Corp.

*Primary Examiner*—Richard Hjerpe

*Assistant Examiner*—Lun-Yi Lao

*Attorney, Agent, or Firm*—Harry M. Weiss & Associates

[57] ABSTRACT

A hardware cursor is implemented on a typical video display controller, and uses an unused portion of video RAM as cursor memory to store the cursor information. Since the cursor memory may be located at any unused location of video RAM, it is a virtual hardware cursor since the location of cursor data may changed as required. The operation of the cursor may be programmed, monitored and controlled via control registers. The hardware cursor monitors the video control signals to determine when to put out cursor data rather than directly outputting pixel data. The hardware cursor fetches the appropriate cursor data from the cursor memory in the video RAM during the horizontal nondisplay period just prior to a line of display data that should contain cursor data. The hardware cursor then monitors the pixel stream and outputs unchanged pixel data until a cursor location is reached, at which time the hardware cursor outputs a logical combination of cursor data, cursor color, and pixel value. The logic of the hardware cursor thus dynamically changes the pixel value to make the cursor appear on the video display monitor without requiring the video controller software to perform the data manipulations and transfers for the cursor.

4 Claims, 2 Drawing Sheets

VIRTUAL MEMORY HARDWARE CUSOR AND METHOD

This is a continuation of application Ser. No. 08/042,331 filed on Apr. 2, 1994 now abandoned.

BACKGROUND OF THE INVENTION

1. Field of the Invention

This invention generally relates to video display systems, and, more specifically, relates to a hardware cursor for a video controller that outputs the cursor on the display monitor without requiring the control software to perform all the computations and data manipulations for the cursor.

2. Description of the Related Art

Most display systems comprise a Video Controller coupled to Video RAM and to a RAMDAC. The RAMDAC converts the digital display information to appropriate analog output voltages for a display monitor. The Video RAM stores the digital display data which the Video Controller outputs to the RAMDAC. In conventional display systems the cursor for the display is generated by the control software for the Video Controller, which keeps track of the location of the cursor, and performs the required manipulations on the display data to make the cursor appear on the display monitor. This software implementation of the cursor creates overhead for the Video Controller software, since it must perform the cursor calculations and store the resultant data for each scan of the display.

Recently some manufacturers of display electronics have implemented a hardware cursor which eliminates this software overhead for the Video Controller by implementing the cursor functions in hardware. One such example is found in the Bt485 RAMDAC by Brooktree Corporation. This RAMDAC has a 64×64×2 Cursor Memory, with Cursor Control Circuitry which automatically outputs the Cursor Data in the Cursor Memory when the scan to the RAMDAC reaches the current cursor location. This frees up the Control Software of the Video Controller from having to perform all the data manipulations for the cursor during each scan. However, this implementation requires 1 Kbyte of RAM on the RAMDAC for the Cursor Memory. This much RAM takes up substantial silicon and increases the complexity of the RAMDAC chip.

Western Digital has also implemented a hardware cursor in their WD90C31 VGA Controller Chip. This implementation is similar to that used by Brooktree, having a 64×64×2 Cursor Memory with Cursor Control Circuitry to perform essentially the same function as the Brooktree part. The primary difference is that the Cursor Memory is not implemented on the WD90C31 chip. Instead, an unused portion of the Video RAM is used as Cursor Memory. This design provides the flexibility of a hardware cursor without the penalty of additional memory to store the cursor information.

The specific design and configuration of the Western Digital part is unknown other than general specifications published in the WD90C31 VGA Controller data sheet (Advanced Information, Aug. 7, 1991). A simple design implementing the functions of a hardware cursor which uses an unused portion of display memory for its Cursor Memory would allow efficient implementation in silicon with a minimum number of gates.

Therefore, there existed a need to provide a hardware cursor that relieves the Control Software from computing and outputting the cursor during each scan, that does not require additional RAM to store the cursor information, and that has a simple design which minimizes the number of gates and hence, the silicon used for its implementation.

SUMMARY OF THE INVENTION

It is an object of this invention to provide a hardware cursor and method which uses an unused portion of Video RAM as Cursor Memory to store the cursor information, which Cursor Memory can be located in any unused portion of Video RAM which provides a contiguous block of unused memory large enough to accommodate the Cursor Memory. This hardware cursor retrieves Cursor Data from the cursor memory in video RAM during the horizontal nondisplay period, has control registers for determining the operational parameters of the hardware cursor, and is implemented in a simple and efficient design minimizing the number of gates and, hence, silicon used for its implementation.

According to the present invention, a display system is provided, comprising a Video Controller, Video RAM, a RAMDAC, and a Display Monitor. The display data is stored in the Video RAM, and the Video Controller outputs this display data from the Video RAM to the RAMDAC, which converts the digital display data to analog signals which are displayed on the Display Monitor. Control Software typically controls the activity of the Video Controller. In the display systems of the prior art, the cursor that appeared on the Display Monitor was a function of the Control Software, which had to keep track of the cursor location and perform the required data manipulations on the display data during a scan to make the cursor appear. The hardware cursor of the present invention, however, allows the Control Software to simply keep track of the cursor location, without requiring the Control Software to perform the logic operations and data manipulations to make the cursor appear. The Hardware Cursor has circuitry which automatically outputs the cursor information to the RAMDAC when the cursor location is encountered during a scan. Rather than create a special RAM for storing Cursor Data, an unused portion of Video RAM is used. Thus, this hardware cursor can be implemented by simply adding some simple circuitry to the Video Controller.

The Video Controller allocates the use of the Video RAM to accommodate both the display data and the Cursor Memory. The cursor can be dynamically located at any location within the Video RAM that provides a block of unused memory large enough to accommodate the cursor. This cursor is therefore a Virtual Memory Hardware Cursor since it can be relocated within the Video RAM as required. This hardware cursor is thus very simple and efficient, and can be provided by adding a relatively small amount of additional logic to the Video Controller.

The Hardware Cursor of the present invention is divided into two functional portions, the Virtual Memory Control block and the Cursor Display block. A set of registers within the Virtual Memory Control block defines the location and configuration of the Cursor Data within Cursor Memory. These registers include: Cursor Memory Start Address, Cursor Configuration, Cursor Status, Cursor Start X, Cursor Start Y, and Line Counter. These registers in conjunction with Video Control signals from the Video Controller control the operation of the Memory Access Control circuit, which determines when to access Cursor Data in the Cursor Memory.

By counting the pulses that occur on the Horizontal Display Enable line from the Video Controller, the Memory Access Control circuit knows which display line is currently being displayed. During the horizontal nondisplay portion of the line prior to displaying the first line containing Cursor Data, the Memory Access Control circuit reads the Cursor Data for that line from the Cursor Memory within the Video RAM, and stores this Cursor Data in two shift registers, a Plane 0 Shift Register and a Plane 1 Shift Register within the Cursor Display block.

A Cursor Display Control circuit within the Cursor Display block monitors both the Horizontal Display Enable and the Vertical Display Enable lines from the Video Controller to determine the current pixel being displayed. At the point within the current line where Cursor Data is needed, the Cursor Display Control circuit shifts the Cursor Data out simultaneously from the Plane 0 Shift Register and from the Plane 1 Shift Register to a Cursor/Pixel Selection circuit, which modifies the incoming pixel data to cause the cursor to appear on the Display Monitor.

The Video Controller determines the operation of the Hardware Cursor by programming several Control Registers within the Hardware Cursor. Since the Hardware Cursor performs the retrieval and manipulation of Cursor Data and the associated logic functions, the Control Software is freed from the overhead of performing these functions. Once the Control Registers are initially programmed to a certain mode, the Control Software needs only to keep the location of the cursor current in the Control Registers.

The foregoing and other objects, features and advantages will be apparent from the following description of the preferred embodiment of the invention as illustrated in the accompanying drawings.

DESCRIPTION OF THE PREFERRED EMBODIMENT

Figure 1:
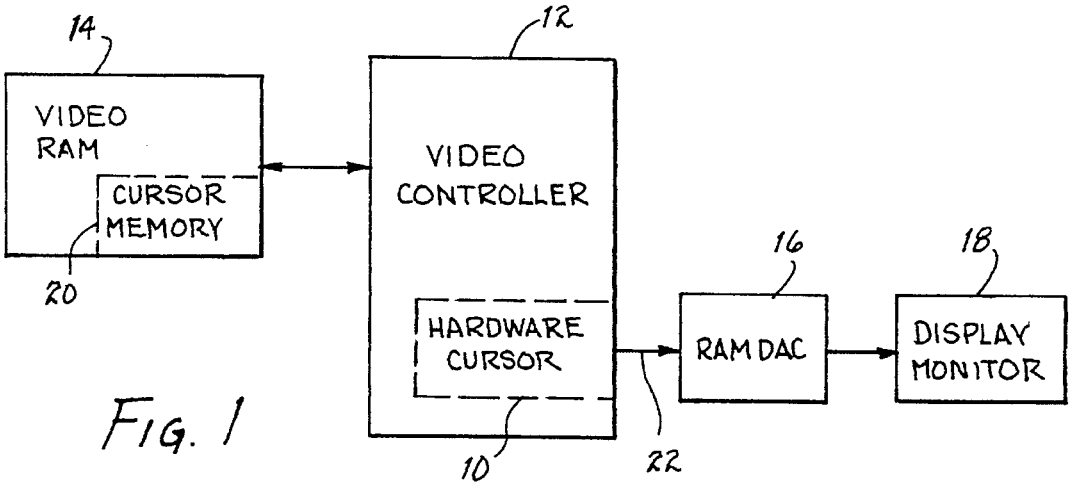
FIG. 1 is a block diagram of a video display system using the hardware cursor of the present invention.

FIG. 1 shows the Hardware Cursor 10 of the present invention being implemented within a Video Controller 12, which is used in a typical video display system including a Video RAM 14, a RAMDAC 16, and a Display Monitor 18. This Hardware Cursor 10 is a 64×64×2 cursor, typically 64 bits high, 64 bits wide, with 2 separate planes for representing four different binary combinations of cursor functions. The Video RAM 14 in this case includes a block of memory that is not used for display data that can be used for Cursor Memory 20 as shown. By implementing the Hardware Cursor 10 on the same semiconductor chip as Video Controller 12, the Hardware Cursor benefits from the presence of many signals on the Video Controller 12 that the Hardware Cursor 10 requires for its operation. In addition, the Hardware Cursor 10 can access Cursor Data within Cursor Memory 20 via the existing interface between Video RAM 14 and Video Controller 12.

The Hardware Cursor 10 has as an input the normal pixel data from the Video Controller 12, and provides an output 22 to RAMDAC 16 which passes directly through all pixel data from Video Controller 12 to RAMDAC 16 unless the particular pixel is in the cursor field. If the particular pixel is in the cursor field, it is operated on by various inputs in the Hardware Cursor 10 to modify the pixel data such that the cursor appears on Display Monitor 18 at that pixel location.

Figure 2:
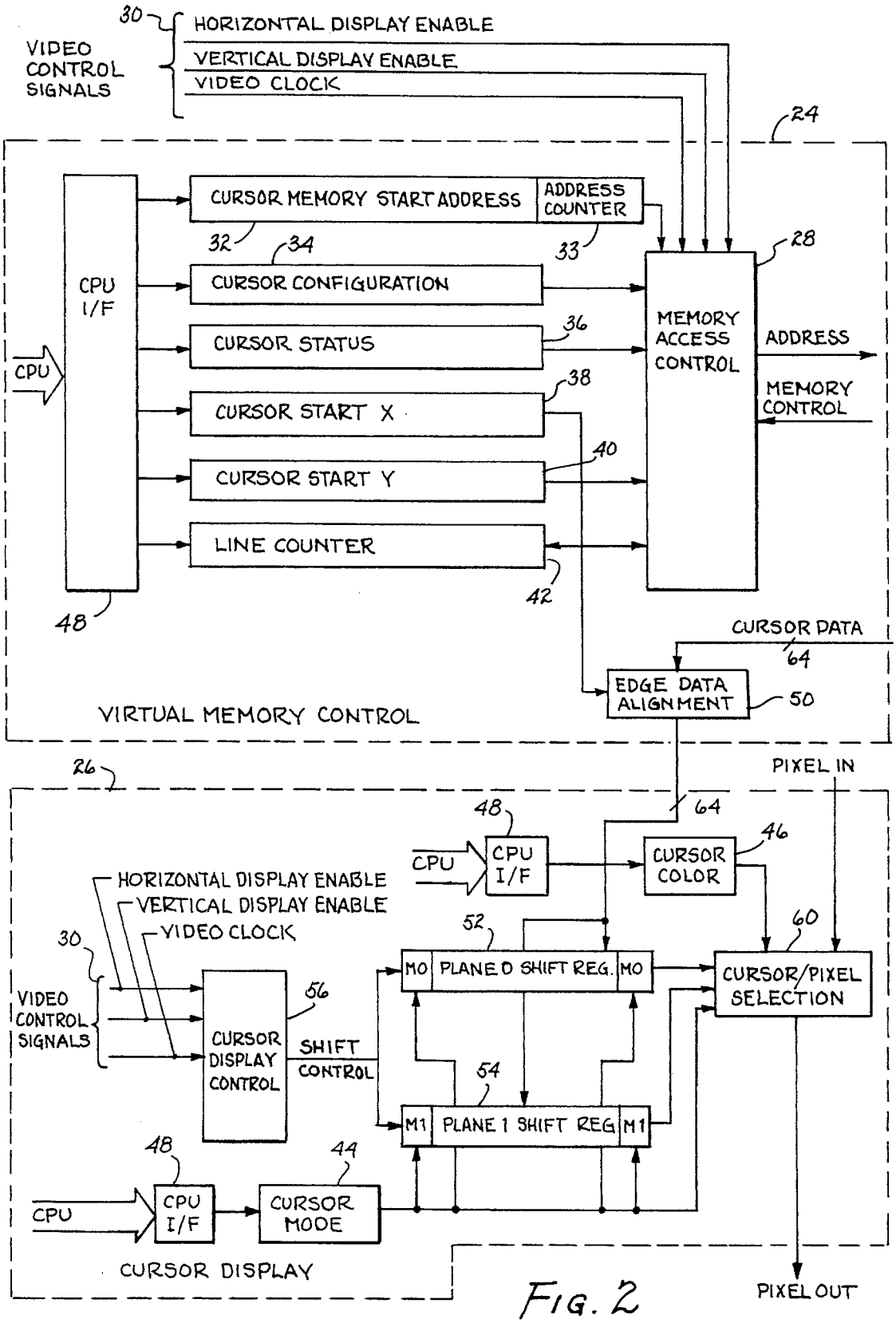
FIG. 2 is a block diagram of the hardware cursor shown in FIG. 1.

FIG. 2 shows the internal configuration of the Hardware Cursor 10 shown in FIG. 1. The functions of Hardware Cursor 10 have been divided up into a Virtual Memory Control block 24 and a Cursor Display block 26. The primary function of Virtual. Memory Control block 24 is to retrieve Cursor Data from the Cursor Memory 20 (shown in FIG. 1), and to provide this data to Cursor Display block 26. The Memory Access Control circuit 28 performs this function in accordance with Video Control Signals 30 from Video Controller 12 (see FIG. 1), and in accordance with inputs from a bank of Programmable Control Registers. These Programmable Control Registers include Cursor Memory Start Address 32, Cursor Configuration 34, Cursor Status 36, Cursor Start X 38, Cursor Start Y 40, and Line Counter 42 as shown in the Virtual Memory Control block 24, and Cursor Mode 44 and Cursor Colors 46 as shown in the Cursor Display block 26. A CPU Interface (I/F) 48 is used to allow an external CPU as may be attached to the Video Controller 12 of FIG. 1 to program these Programmable Control Registers.

The Cursor Memory Start Address register 32 contains the address of the beginning location of Cursor Memory 20 within Video RAM 14 shown in FIG. 1. Cursor Memory 20 can be placed at any location within Video RAM 14 that is not used for display data and has sufficient contiguous memory locations to store the Cursor Data. This makes the Hardware Cursor 10 a Virtual Memory Hardware Cursor since it can be dynamically positioned within the Video RAM 14 as required. Address Counter 33 is used to increment the address of the required Cursor Data so it can be read from Cursor Memory 20 by the Memory Access Control circuit 28.

The Cursor Configuration register 34 is used to set the configuration of the cursor to 8-bits, 16-bits, or 24-bits. The Cursor Status register is used to indicate to the Memory Access Control circuit 28 whether or not the cursor should be displayed. The Cursor Start X register 38 indicates the horizontal starting position of the cursor within the Addressable Display Area. The Cursor Start Y register 40 indicates the vertical starting position of the cursor within the Addressable Display Area. The Line Counter register 42 is used by the Memory Access Control circuit 28 to count the number of Horizontal Display Enable pulses that occur on Video Control Signals 30, and is compared against the value in the Cursor Start Y register 40 to determine when the Memory Access Control circuit 28 needs to access Cursor Data within Cursor Memory 20.

A circuit called Edge Data Alignment 50 determines how Cursor Data retrieved by Memory Access Control circuit 28 from Cursor Memory 20 is stored in the two shift registers 52 and 54 in the Cursor Display block 26. If the cursor position is such that the entire cursor is in the display field, the Edge Data Alignment simple stores each block of 64 bits of Cursor Data directly into the 64 bit shift registers 52 and 54. If, however, the cursor is partially in the display field and partially out of the display field, Edge Data Alignment 50 aligns the Cursor Data to the edge of the display field before storing in the shift registers 52 and 54.

The Cursor Display Control circuit 56 within Cursor Display block 26 monitors Video Control Signals 30 from Video Controller 12 (see FIG. 1) to determine when to shift Cursor Data out of Plane 0 Shift Register 52 and Plane 1 Shift Register 54. The Cursor Mode register 44 and Cursor Color register 46 are programmed by the CPU via the Video Controller 20 to set the mode of operation and the color for the Hardware Cursor 10. Examples of possible modes of operation include 3-color cursor, 2-color/highlight cursor, 2-color/X-Windows cursor, and cursor disabled. The Cursor Color register 46 contains the desired color of the cursor. As is shown in FIG. 2, the Cursor/Pixel Selection circuit 60 has inputs from Cursor Color register 46, from Cursor Mode register 44, from PIXEL IN data from Video Controller 12, and from the Plane 0 Shift Register 52 and the Plane 1 Shift Register 54, and provides a PIXEL OUT output, which goes to the RAMDAC 16 as shown in FIG. 1. The Cursor/Pixel Selection circuit 60 either passes the PIXEL IN data directly through to the PIXEL OUT output (if the current pixel is not in the cursor) or modifies the PIXEL IN data according to the Cursor Color register 46, the Cursor Mode register 44, and the values on the outputs of Plane 0 Shift Register 52 and Plane 1 Shift Register 54. In this manner the PIXEL IN data is dynamically altered to include Cursor Data when appropriate, and is otherwise passed through to PIXEL OUT unchanged.

OPERATION

Figure 3:
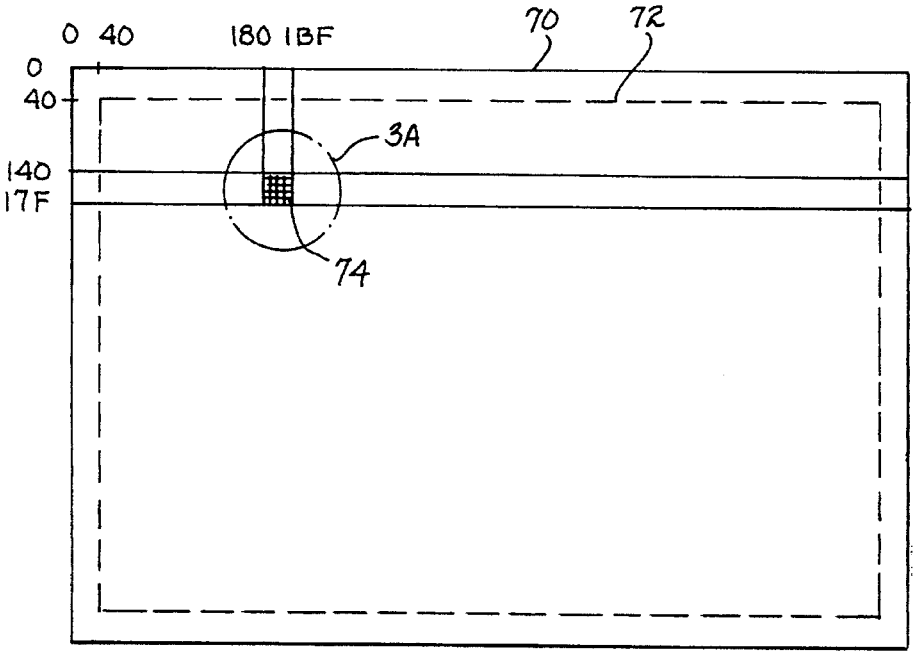
FIG. 3 is a block diagram of the Addressable Display Field and the Display Field on the display monitor of FIG. 1, illustrating the addressing scheme of the Hardware Cursor of FIG. 1.

Upon power-up, a host system CPU must configure the Hardware Cursor 10 via the Video Controller 12 for the proper mode of operation by writing the appropriate data to the Programmable Control Registers, including the location of Cursor Memory 20 within Video RAM 14. Once the Hardware Cursor 10 is configured properly, it is ready for operation. FIG. 3 shows the total Addressable Display Area 70 in which a cursor might be stored, arranged in X–Y cartesian coordinates. The Display Field 72 that shows up on the Display Monitor 18 of FIG. 1 is somewhat smaller than the Addressable Display Area 70, which allows the cursor to only be partially displayed in certain circumstances.

Figure 3A:
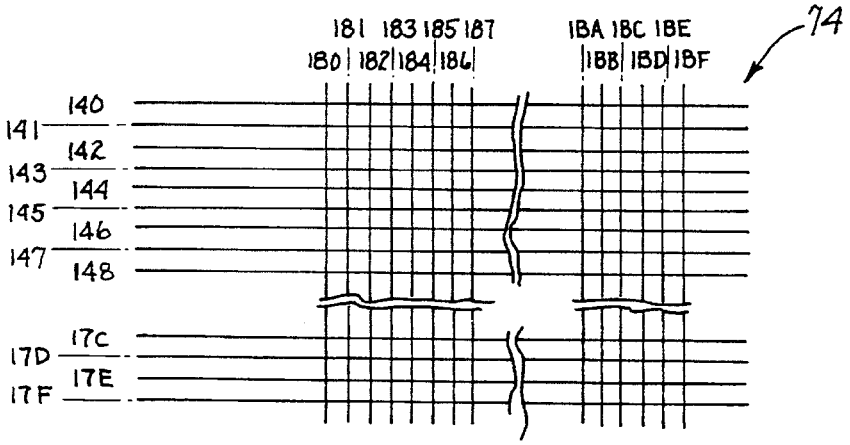
FIG. 3A is an enlarged view of the circled portion 3A in FIG. 3.

Row and column addresses are shown across the top and left side of the Addressable Display Area 70 in hexadecimal format. The junction of each row and column has a unique (X,Y) address which represents a pixel which is displayed on the Display Monitor 18 of FIG. 1. The operation of the Hardware Cursor 10 of the present invention will be explained in relation to the Displayed Cursor 74 as shown in FIGS. 3 and 3A.

Assuming the Display Monitor 18 of FIG. 1 is a non-interlaced display, the Video Controller 12 of FIG. 1 begins the scan of Display Monitor 18 at line 0, and displays each of the lines in sequential order. Since Lines 0–3F are not in the Display Field 72 of FIG. 3, the data on these lines is not displayed. Line 40 is the first line to be output to Display Monitor 18. During the horizontal non-display period prior to displaying line 40, the Hardware Cursor 10 detects that this line does not contain Cursor Data, since the cursor location is at coordinate 180,140 for the example shown in FIGS. 3 and 3A. The Hardware Cursor 10 monitors the Horizontal Display Enable and Vertical Display Enable lines to determine the position of the current line and pixel being displayed. The Hardware Cursor 10 is idle for the first many lines of output, and passes through the PIXEL IN data as shown in FIG. 2 directly to the PIXEL OUT output.

This mode of operation continues up to the horizontal nondisplay period just prior to displaying line 140, and which time the Hardware Cursor 10 recognized that cursor Data is needed for the next line. The Memory Access Control circuit 28 of FIG. 2 then accesses Cursor Data that is in Cursor Memory 20 shown in FIG. 1. The Memory Access Control circuit 28 reads 64 bits of Cursor Data from Cursor Memory 20 and loads this data into Plane 0 Shift Register, and then reads 64 more bits of Cursor Data from Cursor Memory 20 and loads this data into Plane 1 Shift Register. These reads from cursor Memory 20 occur during the horizontal non-display period just prior to line 140 being displayed. Note that the shift outputs of Plane 0 Shift Register 52 and Plane 1 Shift Register 54 are initially in a state that causes the PIXEL IN data to be passed unchanged to the PIXEL OUT output.

As the Horizontal Display Enable line goes active, the Cursor Display Control block 56 then counts the number of video clocks to determine which pixel in line 140 is being displayed. When pixel 180 is reached, Cursor Display Control block 56 simultaneously shifts the Plane 0 Shift Register 52 and the Plane 1 Shift Register 54. In this manner the Cursor Data corresponding to pixel 180 in line 140 is presented to the Cursor/Pixel Selection block 60, which perform a logical function of Cursor Color 46, Plane 0 shift Register 52, Plane 1 Shift Register 54, and the values from Cursor Mode register 44, and modifies PIXEL IN to make the cursor appear at this pixel in the PIXEL OUT data.

When the next pixel (pixel 181) is to be displayed, Cursor Display Control block 56 will detect the Video Clock making another transition, and will shift the Cursor Data in the Plane 0 Shift Register 52 and the Plane 1 Shift Register 54, causing the Cursor Data corresponding to Pixel 181 to be output on the shift outputs of Plane 0 Shift Register 52 and Plane 1 Shift Register 54. The PIXEL IN data will then be modified again by the same combination of inputs as before, providing a modified PIXEL OUT data value which will cause the cursor to appear at pixel 181 of line 140. This process of shifting Cursor Data and modifying the PIXEL IN data continues for 64 locations, until the full 64 pixel width of the cursor on line 140 has been displayed. Once the Cursor Data has been shifted out of Plane 0 Shift Register 52 and Plane 1 Shift Register 54, the output of these shift registers again assume a default value which causes the PIXEL IN data to once again be passed unchanged to the PIXEL OUT output.

During the horizontal nondisplay period after line 140 has been displayed, the Hardware Cursor 10 retrieves the next 64 bits of Cursor Data for the Plane 0 Shift Register 52 and the next 64 bits of Cursor Data for the Plane 1 Shift Register 54, which correspond to the 64 bits of Cursor Data needed for line 141. When pixel 180 is reached, again the Cursor Data will be shifted out to the Cursor/Pixel Selection block 60, to modify the PIXEL IN data to make the cursor appear in the PIXEL OUT data. This continues for the 64 bits of Cursor Data on line 141 between pixels 180 and 1BF as shown in FIG. 3A.

The Hardware Cursor continues this mode of operation for each of the next lines, 142 through 17F. At this point, all the cursor has been displayed, and the Hardware Cursor 10 then stops outputting Cursor Data until the position of the current line and pixel once again lines up with the location of the cursor.

While the invention has been described in its preferred embodiment, it is to be understood that the words which have been used are words of description rather than limitation, and that changes may be made within the purview of the appended claims without departing from the true scope and spirit of the invention in its broader aspects. For example, the number and function of the Programmable Control Registers may be expanded to include a great number of functions. IN addition, this same control circuitry could be used for cursors that are both larger and smaller than the 64×64×2 cursor represented herein for illustrative purposes.

What is claimed is:

1. A hardware cursor for a video display system comprising, in combination:

cursor memory means for storing cursor data, said cursor memory means residing within an unused portion of a video RAM used to store display data within said video display system, said cursor memory means occupying only the number of locations within said video RAM necessary for storing valid cursor data;

memory access control means for reading said valid cursor data from said cursor memory means during the horizontal non-display portion of a scan of said video display system;

first shift register means for storing and shifting a first portion of said valid cursor data to be displayed on said video display system retrieved from said cursor memory means by said memory access control means, and having a shift output for said valid cursor data to be displayed on said video display system;

second shift register means coupled in parallel to said first shift register means for storing and shifting a second portion of said valid cursor data to be displayed on said video display system retrieved from said cursor memory means by said memory access control means, and having a shift output for said valid cursor data to be displayed on said video display system;

cursor display control means for shifting out said valid cursor data stored in said first shift register means and for shifting out said valid cursor data stored in said second shift register means;

a plurality of video control signals comprising horizontal display enable signals, vertical display enable signals, and video clock signals from said video display system coupled to said memory access control means and coupled to said cursor display control means for synchronizing the operation of said memory access control means and said cursor display control means to the output of said display data by said video display system to a display monitor coupled to said video display system;

cursor color means for determining the color of said hardware cursor;

cursor/pixel selection means having an input coupled to a pixel data input from said video display system, said pixel data input providing pixel data comprising a sequence of said display data stored within said video RAM, said cursor/pixel selection means also having an input coupled to said shift output of said first shift register means, having an input coupled to said shift output of said second shift register means, having at least one input coupled to said cursor color means, and having an output that passes through said pixel data from said pixel data input unchanged when said pixel data is not at a location of said hardware cursor, and that modifies said pixel data according to said inputs to make said hardware cursor appear on said display monitor when said pixel data is at a location of said hardware cursor; and programmable control register means coupled to said memory access control means, coupled to said first shift register means, coupled to said second shift register means, and coupled to said cursor/pixel selection means for programming and determining the location and appearance of said hardware cursor on said display monitor, and for determining the location of said cursor memory means within said unused portion of said video RAM.

2. The hardware cursor of claim 1 further comprising CPU interface means coupled to said programmable control register means for allowing a CPU in said video display system to write data into said programmable control register means.

3. A method for providing a hardware cursor for a video display system comprising the steps of:

providing cursor memory means for storing cursor data, said cursor memory means residing within an unused portion of a video RAM used to store display data within said video display system, said cursor memory means occupying only the number of locations within said video RAM necessary for storing valid cursor data;

providing memory access control means for reading said valid cursor data from said cursor memory means during the horizontal non-display portion of a scan of said video display system;

providing first shift register means for storing and shifting a first portion of said valid cursor data to be displayed on said video display system retrieved from said cursor memory means by said memory access control means, and having a shift output for said valid cursor data to be displayed on said video display system;

providing second shift register means coupled in parallel to said first shift register means for storing and shifting a second portion of said valid cursor data to be displayed on said video display system retrieved from said cursor memory means by said memory access control means, and having a shift output for said valid cursor data to be displayed on said video display system;

providing cursor display control means for shifting out said valid cursor data stored in said first shift register means and for shifting out said valid cursor data stored in said second shift register means;

providing a plurality of video control signals comprising horizontal display enable signals, vertical display enable signals, and video clock signals from said video display system coupled to said memory access control means and coupled to said cursor display control means for synchronizing the operation of said memory access control means and said cursor display control means to the output of said display data by said video display system to a display monitor coupled to said video display system;

providing cursor color means for determining the color of said hardware cursor;

providing cursor/pixel selection means having an input coupled to a pixel data input from said video display system, said pixel data input providing pixel data comprising a sequence of said display data stored within said video RAM, said cursor/pixel selection means also having an input coupled to said shift output of said first shift register means, having an input coupled to said shift output of said second shift register means, having at least one input coupled to said cursor color means, and having an output that passes through said pixel data from said pixel data input unchanged when said pixel data is not at a location of said hardware cursor, and that modifies said pixel data according to said inputs to make said hardware cursor appear on said display monitor when said pixel data is at a location of said hardware cursor;

providing programmable control register means coupled to said memory access control means, coupled to said first shift register means, coupled to said second shift register means, and coupled to said cursor/pixel selection means for programming and determining the location and appearance of said hardware cursor on said display monitor, and for determining the location of said cursor memory means within said unused portion of said video RAM, programming said programmable control register means with the location and appearance of said hardware cursor;

programming said programmable control register means with the location of said cursor memory means within said unused portion of said video memory; and storing said valid cursor data within said cursor memory means.

4. A hardware cursor for a display system comprising, in combination:

cursor memory means for storing cursor data, said cursor memory means residing within an unused portion of a video memory used to store display data within said display system, said cursor memory means occupying only the number of locations within said video memory necessary for storing valid cursor data;

memory access control means for reading said valid cursor data from said cursor memory means during the horizontal non-display portion of a scan of said display system;

one shift register means for storing and shifting a first portion of said valid cursor data to be displayed on said video display system retrieved from said cursor memory means by said memory access control means, and having a shift output for said valid cursor data to be displayed on said video display system;

another shift register means coupled in parallel to said one shift register means for storing and shifting a second portion of said valid cursor data to be displayed on said video display system retrieved from said cursor memory means by said memory access control means, and having a shift output for said valid cursor data to be displayed on said video display system;

cursor display control means for shifting out said valid cursor data stored in said one shift register means and for shifting out said valid cursor data in said another shift register means;

a plurality of video control signals comprising horizontal display enable signals, vertical display enable signals, and video clock signals from said video display system coupled to said memory access control means and coupled to said cursor display control means for synchronizing the operation of said memory access control means and said cursor display control means to the output of said display data by said video display system to a display monitor coupled to said video display system;

cursor color means for determining the color of said hardware cursor;

cursor/pixel selection means having an input coupled to a pixel data input from said display system, said pixel data input providing pixel data comprising a sequence of said display data stored within said video memory, said cursor/pixel selection means also having an input coupled to said shift output of said one shift register means, having an input coupled to said shift output of said another shift register means, having at least one input coupled to said cursor color means, and having an output that passes through said pixel data from said pixel data input unchanged when said pixel data is not at a location of said hardware cursor, and that modifies said pixel data according to said inputs to make said hardware cursor appear on said display monitor when said pixel data is at a location of said hardware cursor; and programmable control register means coupled to said memory access control means, coupled to said one shift register means, coupled to said another shift register means, and coupled to said cursor/pixel selection means for programming and determining the location and appearance of said hardware cursor on said display monitor, and for determining the location of said cursor memory means within said unused portion of said video memory.

* * * * *